US005826812A

United States Patent [19]

Hand

[11] Patent Number: 5,826,812

[45] Date of Patent: Oct. 27, 1998

[54] COILER APPARATUS AND METHOD

[75] Inventor: Edward Lowe Hand, Belmont, N.C.

[73] Assignee: Belmont Textile Machinery Co., Inc., Belmont, N.C.

[21] Appl. No.: 780,458

[22] Filed: Jan. 8, 1997

[51] Int. Cl.[6] ..... B21C 47/24; B21C 47/14

[52] U.S. Cl. ..... 242/363; 242/47.01; 242/53; 242/361.2; 242/361.3

[58] Field of Search ..... 242/361, 363, 242/361.2, 361.3, 47.01, 53

[56] References Cited

U.S. PATENT DOCUMENTS

| | | | |
|---|---|---|---|
| 2,447,982 | 8/1948 | Koster | 242/1 |
| 2,629,564 | 2/1953 | Bell | 242/363 X |
| 3,241,786 | 3/1966 | Bittman | 242/363 X |
| 3,260,471 | 7/1966 | Crum | 242/363 |
| 3,405,885 | 10/1968 | Schroder et al. | 242/83 |
| 3,430,312 | 3/1969 | Drummond | 28/1 |
| 3,469,798 | 9/1969 | Schroder | 242/83 |
| 3,491,561 | 1/1970 | Crump | 68/202 |
| 3,563,488 | 2/1971 | Bollig | 242/363 X |
| 3,647,154 | 3/1972 | Pamplin | 242/363 X |
| 3,703,090 | 11/1972 | Rosen | 66/132 R |
| 3,994,446 | 11/1976 | Jacobsson | 242/47.01 |
| 4,109,357 | 8/1978 | Burow et al. | 28/289 |
| 4,221,031 | 9/1980 | Gilbos | 28/281 |
| 4,432,501 | 2/1984 | Arendt et al. | 242/53 X |
| 4,432,503 | 2/1984 | Wedler | 242/53 X |
| 4,785,510 | 11/1988 | Asfour | 242/47.01 X |
| 5,024,390 | 6/1991 | Enderlin | 242/47.12 |

FOREIGN PATENT DOCUMENTS

| | | | |
|---|---|---|---|
| 0 525 906 A1 | 2/1993 | European Pat. Off. . | |
| 1366282 | 6/1964 | France | 242/363 |
| 1.602.027 | 12/1968 | France . | |
| 4109201 | 9/1992 | Germany | 242/363 |

*Primary Examiner*—Daniel P. Stodola
*Assistant Examiner*—Tina R. Taylor
*Attorney, Agent, or Firm*—Adams Law Firm, P.A.

[57] ABSTRACT

A coiler apparatus for forming flat coils of textile strands from an upstream strand supply and depositing the coils on a moving conveyor belt for transport downstream to a strand processing station. The coiler apparatus includes a driven rotating arm for forming successive vertical coils of a textile strand received by the rotating arm from the upstream strand supply, a coil support for receiving and supporting each vertical coil as it is formed by the rotating arm, a coil doffer positioned proximate a lower extent of the coil support for progressively doffing a lower portion of successive ones of the coils from the coil support in advance of an upper portion of the coils, and a coil guide extending downstream from the coil doffer for guiding the upper portion of the coils off of the coil support as the lower portion of the coils is doffed by the coil doffer, and for permitting a controlled transition of the coils from their vertical orientation into an array of overlapping, stretched-out coils on the moving conveyor belt.

18 Claims, 6 Drawing Sheets

COILER APPARATUS AND METHOD

TECHNICAL FIELD AND BACKGROUND OF THE INVENTION

This invention relates to a coiler apparatus of the type used to form flat coils of yarn during various types of yarn processing. In this application the coiler is described in conjunction with a continuous yarn dyeing system, such as long and short space dyeing and solid shade dyeing. The coiler is used to place the yarn in a relatively compact, uniform array which can be processed with uniform applications of dye and/or steam. The yarn must be coiled in such a manner as to permit rewinding of the yarn from coil form back onto a suitable yarn package without tangling or knotting.

Prior art coilers generally form either round or substantially round coils which do not allow uniform density of the yarn on as deposited on the conveyor. This can result in a lack of homogeneous yarn retraction during thermal treatment. Round loops or coils present a much higher overall density of material on the sides than at the center, resulting in substantially different characteristics being imparted to the yarn residing on the sides of the coils. This can result in variations in dyeing shades in yarn.

Prior art devices which disclose formation of oval coils or loops are relatively complicated and present other processing problems. An example of such a device is shown in U.S. Pat. No. 5,024,390.

SUMMARY OF THE INVENTION

Therefore, it is an object of the invention to provide a simple and reliable coiler for use in textile yarn processing.

It is another object of the invention to provide a coiler which forms an oval coil having a geometry which maximizes uniform exposure of the yarn to treatment conditions.

It is another object of the invention to provide a coiler which permits controlled collapse of the round yarn coils into an oval coil having a proper geometry.

It is another object of the invention to provide a coiler which can operate in either a horizontal or vertical orientation.

It is another object of the invention to provide a process for forming yarn coils.

These and other objects of the present invention are achieved in the preferred embodiments disclosed below by providing a coiler apparatus for forming flat coils of textile strands from an upstream strand supply and depositing the coils on a moving conveyor belt for transport downstream to a strand processing station. The coiler apparatus comprises a driven rotating arm for forming successive vertical coils of a textile strand received by the rotating arm from the upstream strand supply, coil support means for receiving and supporting each vertical coil as it is formed by the rotating arm, coil doffing means positioned proximate a lower extent of the coil support means for progressively doffing a lower portion of successive ones of the coils from the coil support means in advance of an upper portion of the coils, and coil guiding means extending downstream from the coil doffing conveyor for guiding the upper portion of the coils off of the coil support means as the lower portion of the coils is doffed by the coil doffing means, and for permitting a controlled transition of the coils from their vertical orientation into an array of overlapping coils on the moving conveyor belt.

According to one preferred embodiment of the invention, the coil support means comprises an annular drum having a horizontally-extending axis and a radially-extending annular surface for receiving the strand from the rotating arm as the coils are formed.

According to another preferred embodiment of the invention, the coil support means comprises an annular drum having a horizontally-extending axis and a radially-extending annular surface for receiving the strand from the rotating arm as the coils are formed. The radially-extending annular surface includes a tapered segment adapted for sliding downstream movement of the coils onto the coil guiding means.

According to yet another preferred embodiment of the invention, the coil doffing means comprises an endless doffing conveyor having a coil-doffing lower surface for moving the lower portion of the coils downstream therefrom.

According to yet another preferred embodiment of the invention, the coil doffing means comprises a pair of laterally spaced-apart endless belts each defining a coil-doffing lower surface for moving the lower portion of the coils downstream therefrom.

According to yet another preferred embodiment of the invention, the coil guiding means comprises a plurality of guide members projecting outwardly from the coil support means in the downstream direction therefrom.

According to yet another preferred embodiment of the invention, the guide members comprise a plurality of coil-guiding rods positioned on the coil support means and extending outwardly from the coil support means in a downstream and downwardly-extending direction towards the coil doffing means.

According to yet another preferred embodiment of the invention, the coil-guiding rods are of differing lengths, with at least some of the coil-guiding rods being relatively shorter than other of the coil-guiding rods. At least some of the coil-guiding rods are straight and some of the other of the coil-guiding rods are bent to define respective axially-inwardly extending segments.

According to yet another preferred embodiment of the invention, the rotating arm comprises a hollow tube for receiving the strand in an upstream strand-receiving opening therein and discharging the strand through a downstream, radially-outwardly extending opening therein.

According to another preferred embodiment of the invention, a coiler apparatus is provided for forming flat coils of textile strands from an upstream strand supply and depositing them on a moving conveyor belt for transport downstream to a strand processing station. The coiler apparatus includes a driven rotating arm for forming successive vertical coils of a textile strand received by the rotating arm from the upstream strand supply. The rotating arm comprises a hollow tube for receiving the strand in an upstream strand-receiving opening therein and discharging the strand through a downstream, opening in a radially-outwardly extending segment of the arm. A coil support means is provided for receiving and supporting each vertical coil as it is formed by the rotating arm. The coil support means comprises an annular drum having a horizontally-extending axis and a radially-extending annular surface for receiving the strand from the rotating arm as the coils are formed. Coil doffing means are positioned proximate a lower extent of the annular drum for progressively doffing a lower portion of successive ones of the coils from the annular drum. The coil doffing means comprises an endless doffing conveyor having a coil-doffing lower surface for engaging and moving the lower portion of the coils downstream therefrom in advance of the upper portion of the coils. Coil guiding means extend downstream from the coil doffing conveyor for guiding an upper portion of the coils off of the drum as the lower portion of the coils are doffed by the coil doffing conveyor for permitting a controlled transition of the coils from their vertical orientation into an array of overlapping flat coils on the moving conveyor belt. The coil guiding means comprises a plurality of guide members projecting outwardly from the coil support means in the downstream direction therefrom.

According to another preferred embodiment of the invention, the endless doffing conveyor comprises a pair of laterally spaced-apart endless belts each defining a coil-doffing lower surface for moving the lower portion of the coils downstream therefrom.

According to yet another preferred embodiment of the invention, the guide members comprise a plurality of coil-guiding rods positioned on the coil support means and extending outwardly from the coil support means in a downstream and downwardly-extending direction towards the coil doffing means.

Preferably, the guide members include a plurality of coil-guiding rods positioned on the coil support means and extend outwardly from the coil support means in a downstream and downwardly-extending direction towards and into engagement with the coil doffing means. The engagement of the coil-guiding rods with the coil doffing means maintains the coil support means in a stationary position relative to coil doffing means.

According to yet another preferred embodiment of the invention, the coil-guiding rods are of differing lengths, with at least some of the coil-guiding rods being relatively shorter than other of the coil-guiding rods. At least some of the coil-guiding rods are straight and wherein other of the coil-guiding rods are bent to define respective axially-inwardly extending segments.

An embodiment of the method for forming flat coils of textile strands from an upstream strand supply and depositing the coils on a moving conveyor belt for transport downstream to a strand processing station according to the invention comprises the steps of forming successive vertical coils of a textile strand received by from the upstream strand supply, receiving and supporting each vertical coil in a vertical orientation as it is formed, progressively doffing a lower portion of successive ones of the coils in advance of an upper portion of the coils, and guiding the upper portion of the coils as the lower portion of the coils is doffed by the coil doffing means in a controlled transition of the coils from their vertical orientation into an array of overlapping coils on the moving conveyor belt.

According to yet another preferred embodiment of the invention, the step of supporting the coils comprises the step of placing each of the coils successively on an annular support having a horizontally-extending axis and a radially-extending annular surface for receiving the strand as the coils are formed.

According to yet another preferred embodiment of the invention, the step of supporting the coils comprises the step of placing each of the coils successively on an annular support having a horizontally-extending axis and a radially-extending annular surface for receiving the strand as the coils are formed. The radially-extending annular surface includes a tapered segment adapted for sliding downstream movement of the coils.

According to yet another preferred embodiment of the invention, the step of doffing the coils comprises the step of depositing the lower portion of the coils on an endless doffing conveyor having a coil-doffing lower surface for moving the lower portion of the coils downstream therefrom.

According to yet another preferred embodiment of the invention, the step of guiding the upper portion of the coils comprises the step of guiding the upper portion of the coils onto a plurality of guide members projecting in the downstream direction.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
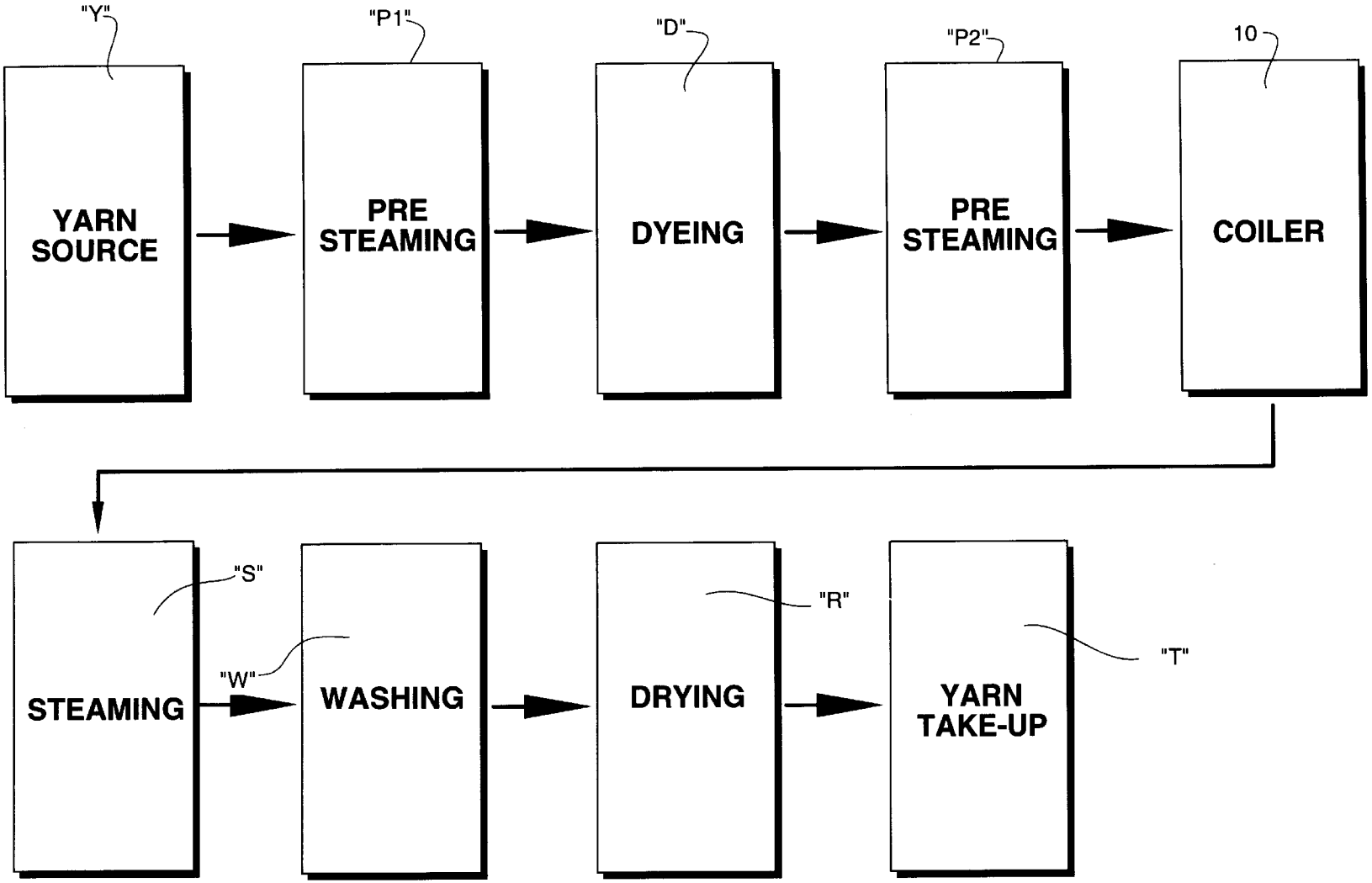
FIG. 1 is a flow diagram of a yarn processing range incorporating a coiler according to a preferred embodiment of the invention disclosed in the application.

Referring now specifically to the drawings, a flow diagram of a yarn processing range incorporating a coiler according to the present invention is illustrated in FIG. 1 and shown generally at reference numeral 10. Yarn, for example nylon or polyester of between 900 denier singles to 2,400 denier two-ply, is delivered from an upstream yarn source "Y" to a first pre-steaming range "P1" and then to a dyeing range "D" where the yarn is dyed. The dyed yarn is then delivered to a second pre-steaming range "P2". Yarn from the pre-steaming range "P2" is then delivered to the coiler apparatus 10 where the yarn is coiled as described below. The yarn is them steamed in a steamer "S", washed in a washer "W", dried in a dryer "R" before being taken up onto a yarn package at the yarn take-up "T". The processes identified generally above as "Y", "P1", "D", "P2", "S", "W", "R" and "T" are conventional and are not described further.

Figure 2:
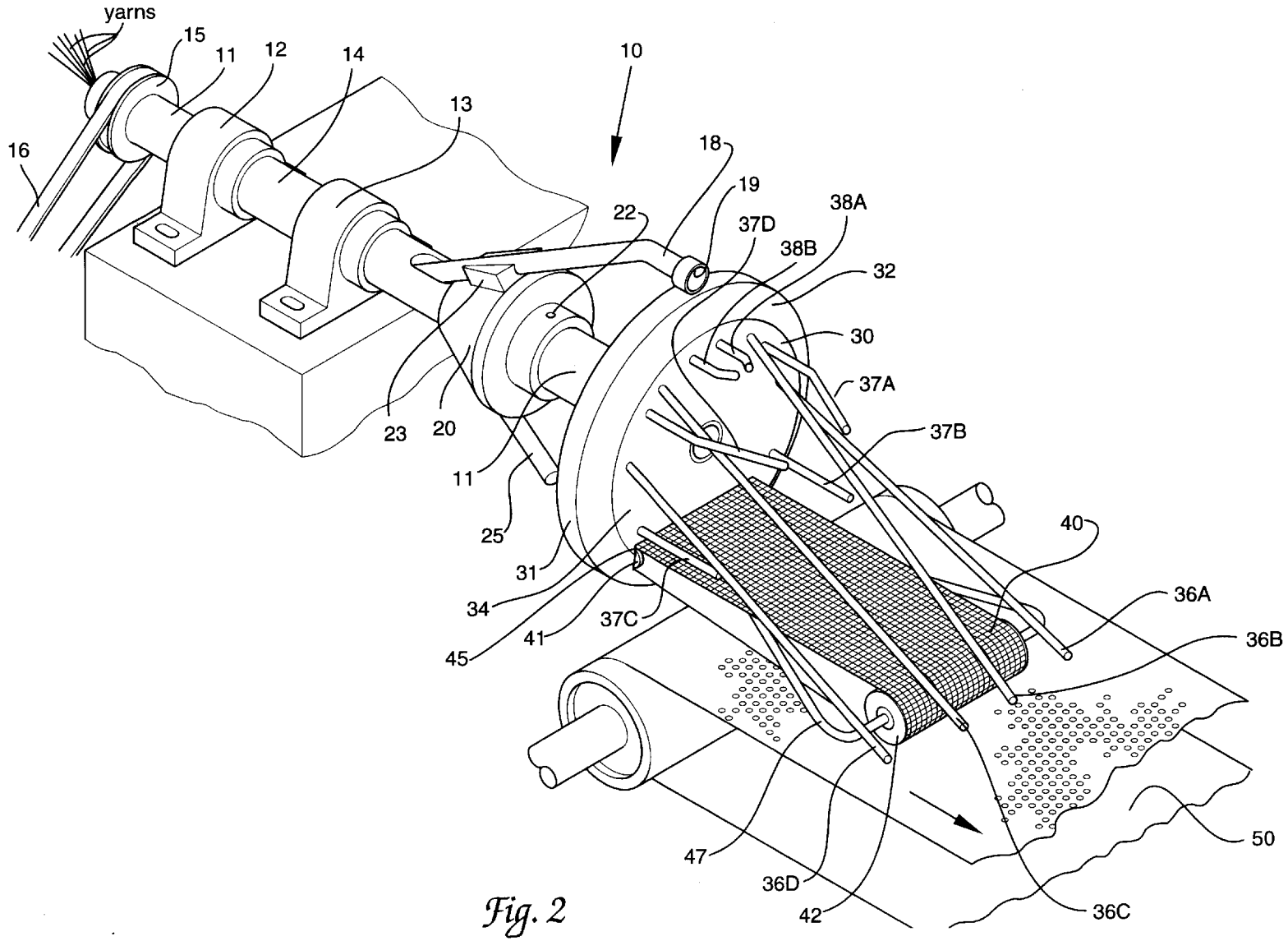
FIG. 2 is a perspective view of one embodiment of the coiler according to the invention.

Referring now to FIG. 2, the coiler 10 according to an embodiment of the invention is shown. Yarns, which may be any number but typically may be 24–48 ends or more in number, are delivered from an upstream processing station and condensed into the upstream end of a yarn delivery tube 11. The yarn delivery tube 11 is supported for rotation in bearing blocks 12 and 13 by being concentrically positioned for rotation in a stationary support tube 14. A pulley 15 is driven by a belt 16 which is in turn driven by a motor, not shown. The yarn is delivered from upstream at a rate of delivery which is set to match the output of the coiler 10. The yarn passes down the delivery tube 11 and into a tubular arm 18 which flares radially outwardly to define an enlarged radius of rotation. The condensed yarn exits the arm 18 through a outlet 19. The arm 18 is supported by an annular sleeve 20 fixed for rotation on the delivery tube 11 by a set screw 22. The arm 18 is supported on the sleeve 20 by a support bracket 23. The arm 18 is counterbalanced by a diametrically-positioned balance arm 25.

Yarn is delivered from the outlet 19 to a coil-supporting drum 30. The drum 30 is mounted on the downstream end of the rotating delivery tube 11 by suitable bearings for rotational movement relative to the delivery tube 11.

Drum 30 has a horizontally-extending axis and a radially-extending annular surface 31. The diameter of the drum 30 is determined by yarn size, range speed and production rates, but may be, for example, 16 inches in diameter. The radially extending surface 31 includes a tapered segment 32 onto which the yarn coils are applied by the arm 18.

The forwardly-directed face 34 of the drum 30 carries several coil guiding rods 36A–D, 37A–D and 38A–B. The four guiding rods 36A–D are relatively straight and long, and extend generally downwardly from the upper half of the drum 30 towards a coil doffing conveyor 40. As noted above, the drum 30 is mounted on bearings for rotational movement relative to the delivery tube 11. This means that as the delivery tube 11 rotates, the drum 30 does not rotate, but remains in a fixed, non-rotating position relative to the delivery tube 11. The drum 30 is prevented from rotating by the engagement of the coil guiding rods 35A–D against the doffing conveyor 40 and a yarn conveyor belt 50, described in further detail below. Thus, the drum 30 and the delivery tube 11 move relative to each other without the necessity of a planetary gearing arrangement or magnetic holder.

In the embodiment of FIG. 2, the doffing conveyor 40 is formed of plastic or rubber material formed into an endless belt extending laterally from one side of the drum 30 to the other. The conveyor 40 is supported for rotation by rollers 41 and 42. The roller 41 is positioned for rotation in a pocket 45 formed in the lower area the drum 30. The roller 42 is carried on a bracket 47 connected to the drum 30.

Figure 3A:
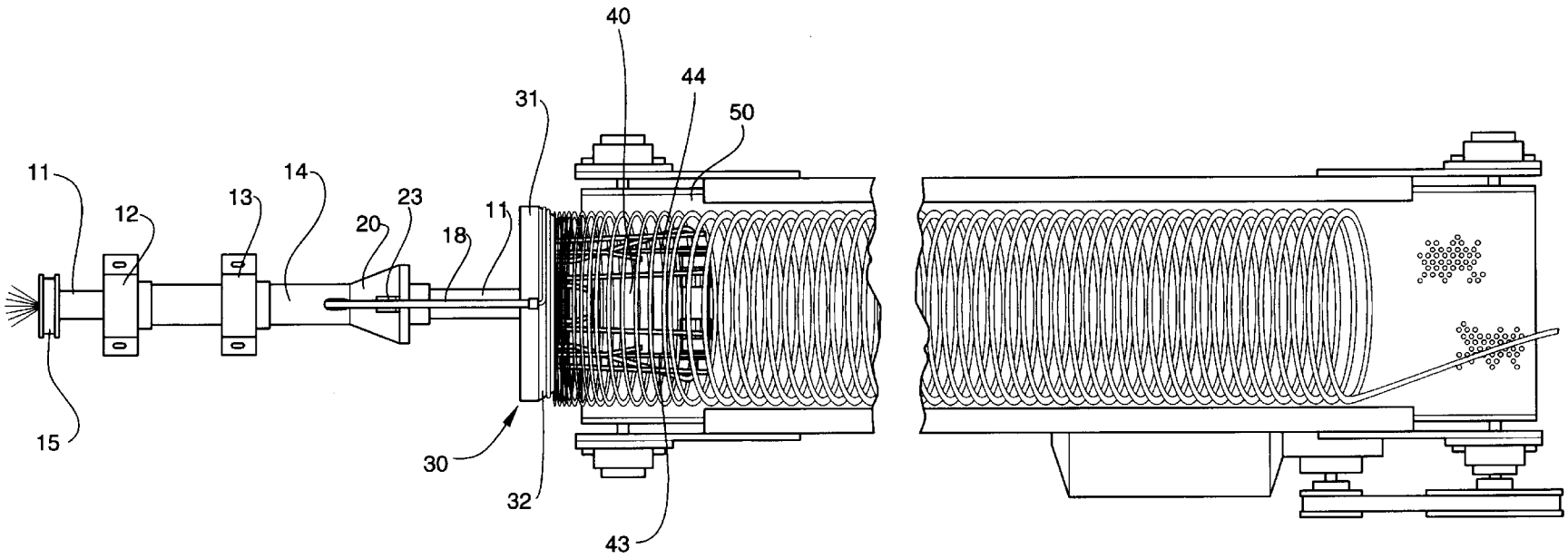
FIG. 3A is a top plan view of another embodiment of the coiler disclosed in the application.
Figure 3B:
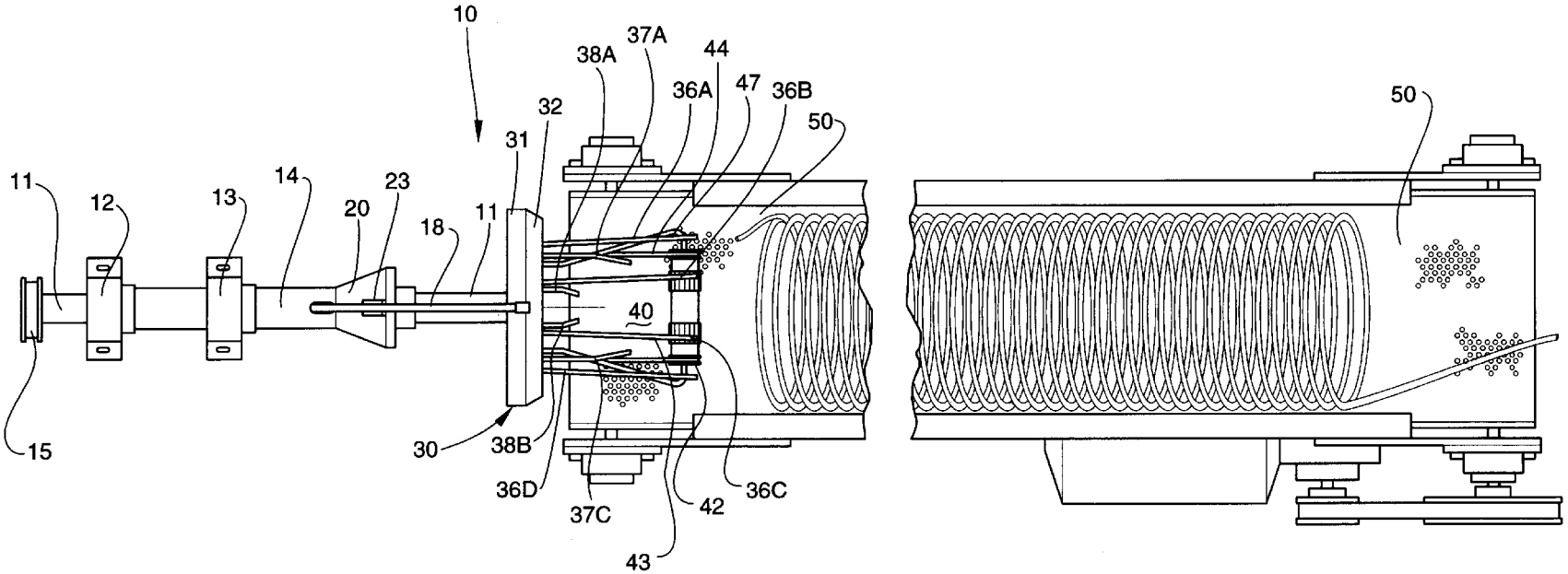
FIG. 3B is a top plan view of the coiler shown in FIG. 2A, with a portion of the yarn coils removed for clarity.
Figure 4:
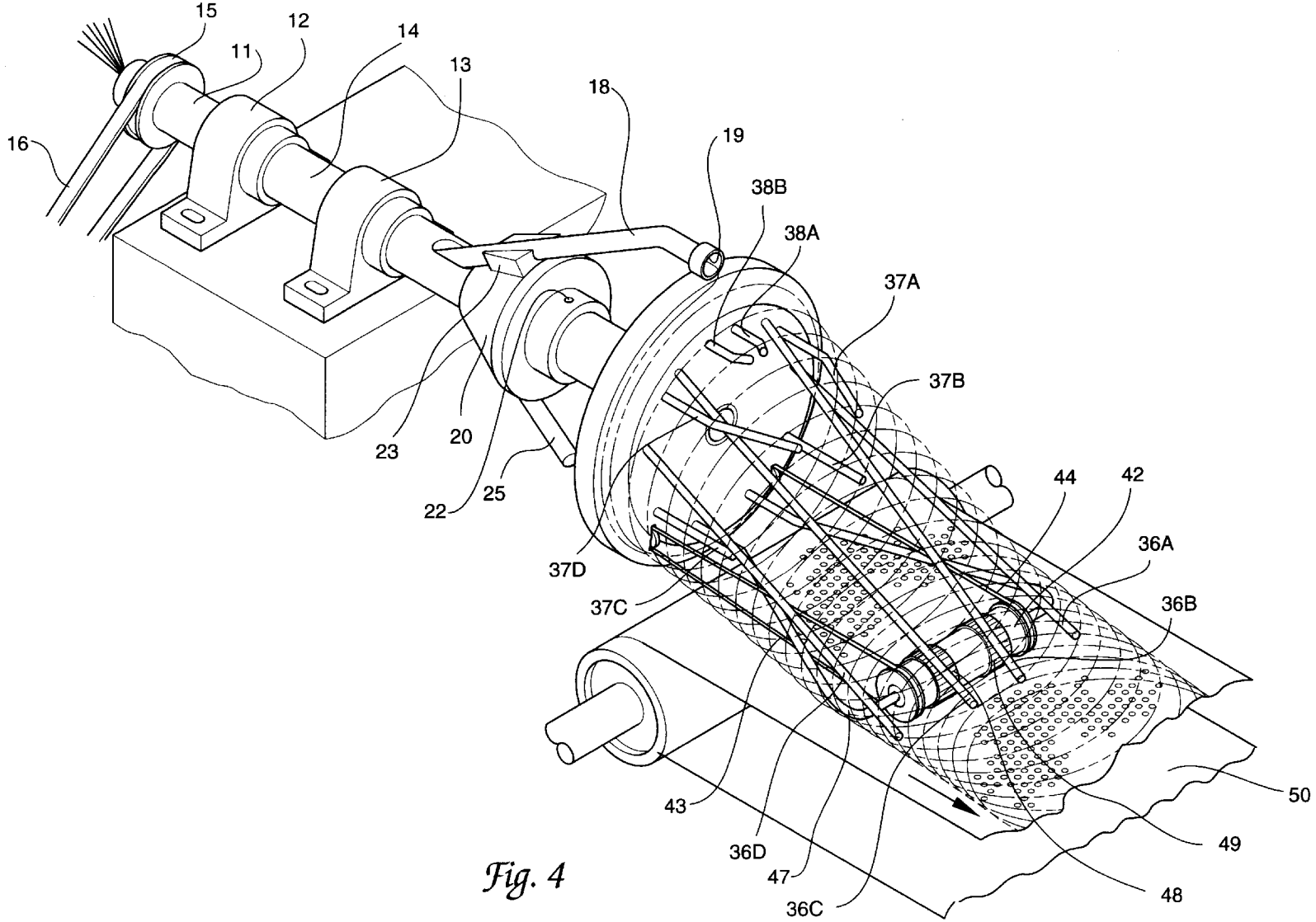
FIG. 4 is a perspective view, with the yarn shown in phantom for clarity, of the coiler shown in FIGS. 3A and 3B.

In the embodiment shown in FIGS. 3A, 3B and 4, the doffing conveyor 40 is formed of a pair of endless rubber belts 43 and 44 which extend between rollers 41 and 42. A pair of rubber or plastic-treated drive rings 48 and 49 are mounted on the roller 42 and engage the conveyor belt 50. The conveyor belt 50 is driven through a suitable motor-driven drive train, not shown. Movement of the conveyor belt 50 drives the belts 43 and 44.

The four guiding rods 37A–D are relatively shorter than the guiding rods 36A–D and are peripherally positioned to maintain the formation of the coil of yarn as it begins to collapse towards the doffing conveyor 40. In the particular embodiment shown in the drawings, the upper guiding rods 37A and 37D are bent inwardly to the guide the coil inwardly slightly as it collapses, whereas the lower guiding rods 37B and 37C are straight.

The two guiding rods 38A–B are bent inwardly slightly and support the top of the coil as it is pushed off of the tapered segment 32 of the drum 30, then release the coils and allow them to travel the length of the guiding rods 36A–D to the coil doffing conveyor 40. The precise arrangement of the guiding rods as well as their length, angle of extension relative to the drum 30, angle of bend, if any, and similar features can be varied depending on the type and size of yarn being processed, conveyor speed and similar variables.

As the coils slide off of the guiding rods 36A–D they are deposited onto the moving conveyor belt 50 which conveys the coils to a downstream processing station such as the steamer "S" shown by way of example in FIG. 1. The conveyor belt 50 will normally comprise a perforated stainless steel belt on which the coils of yarn reside during downstream processing.

FIG. 3A shows the arrangement of the coils on the conveyor 50.

FIG. 3B shows the same arrangement as FIG. 3B, with the coils nearest the coiler 10 removed to more clearly illustrate the structure of the coiler 10 in top plan view. The coils are shown in phantom lines in FIG. 4, which shows the formation of the coils on the coiler 10 in perspective view. Note that the coils are formed with the bottom of each coil positioned forward, i.e., downstream, of the top of each coil. In other words, the coils appear to lean rearward rather than forward as in some prior art coilers. The coil orientation shown in the figures is the ideal orientation for rewinding the coils after processing is completed.

Ideally, the oval-shaped coils formed have the same circumference as the circular coils as they are formed on the drum 30, expressed by the formula $\Pi d/2$ where d=coil diameter on the drum 30. This optimizes the position of the coils on the conveyor 50 and best approximates the ideal coil position wherein the density of the coils is relatively uniform lengthwise and widthwise on the conveyor 50.

Figure 5B:
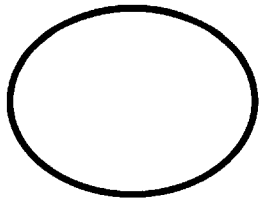
FIGS. 5B, 5C, 5D and 5E are cross-sections taken through four sequential positions of the coils during coil formation shown in FIG. 5A.
Figure 5C:
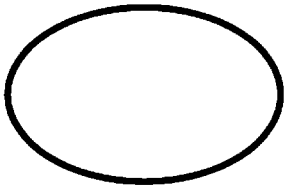
Figure 5D:
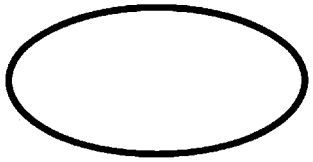
Figure 5E:
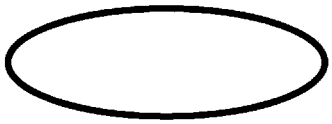
Figure 5A:
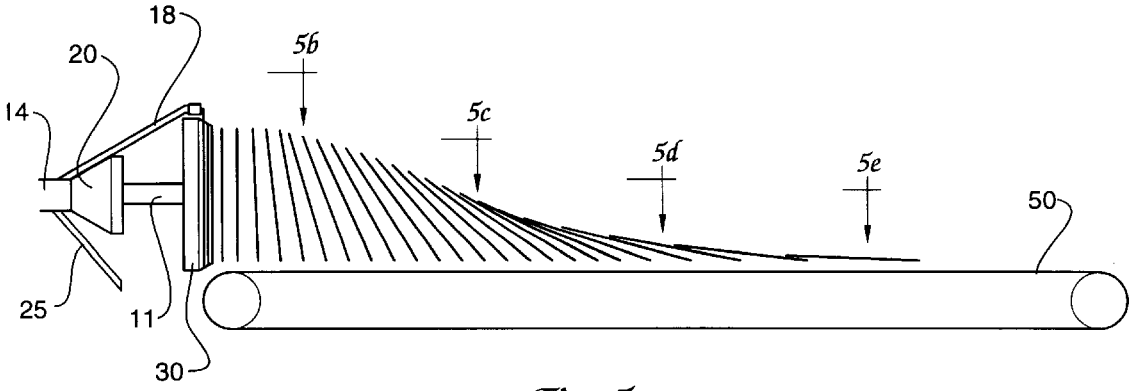
FIG. 5A is a schematic side elevation of the coiler showing sequentially the formation of the coils.

As is shown schematically in FIG. 5A, the coils progressively recline as they are formed on coiler 10. FIGS. 5B–E illustrate that the coils become progressively less circular in shape as they proceed down the guiding rods 36A–D onto the conveyor belt 50. The width of the coils when deposited on the conveyor belt 50 is progressively greater than the diameter of the coils when initially formed on the drum 30 due to the lateral elongation of the coils as they proceed down the guiding rods 36A–D and are laid onto the conveyor belt 50.

Desired variations in the precise shape of the coils can be made by varying the rate of travel of the doffing conveyor 40 in relation to the rpm of the drum arm 18 and the rate of travel of the conveyor belt 50. Typical delivery rates of yarn can be expected to range between 25–600 yards/minute.

A coiler apparatus of the type used to form flat coils of yarn during various types of yarn processing and a related method is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A coiler apparatus for forming flat coils of textile strands from an upstream strand supply and depositing the coils on a moving conveyor belt for transport downstream to a strand processing station, comprising:

(a) a driven rotating arm for forming successive coils of a textile strand received by said rotating arm from the upstream strand supply, said arm mounted for rotation about a horizontal axis;

(b) a coil-shaping template positioned in strand-receiving relation to said rotating arm and having a downstream-facing tapered annular surface for receiving the strand from said arm and forming the strand into an upright circular coil having an orientation perpendicular to the axis of rotation of said rotating arm;

(c) a coil doffer, comprising:

(i) a lower coil guide positioned proximate a lower extent of said template for progressively engaging and removing a lower portion of successive ones of said upright coils from said template in advance of an upper portion of said coils and applying the lower portion of each coil successively to said conveyor at a first rate of travel as said coils move downstream along said conveyor;

(ii) an upper coil guide extending downstream firm said template for guiding the upper portion of each coil off of said template at a second rate of travel less than said first rate of travel as the lower portion of each coil is removed from the template by the lower coil guide for permitting a controlled transition of said coils from their circular, vertical orientation on said template into an array of oval, overlapping coils on said moving conveyor belt.

2. A coiler apparatus according to claim 1, wherein said template comprises an annular drum having a horizontally-extending axis.

3. A coiler apparatus according to claim 1, wherein said lower coil guide comprises an endless doffing conveyor having a coil-doffing upper surface for moving the lower portion of said coils downstream therefrom and depositing the coils on said conveyor belt.

4. A coiler apparatus according to claim 1, wherein said lower coil guide comprises a pair of laterally spaced-apart endless belts each defining a coil-doffing upper surface for moving the lower portion of said coils downstream therefrom and depositing the coils on said conveyor belt.

5. A coiler apparatus according to claim 1, wherein said upper coil guide comprises a plurality of guide members projecting outwardly from said template in the downstream direction therefrom.

6. A coiler apparatus according to claim 5, wherein said guide members comprise a plurality of coil-guiding rods positioned in coil-receiving relation to said template and extending outwardly from said template in a downstream and downwardly-extending direction towards said conveyor belt.

7. A coiler apparatus according to 6, wherein said coil-guiding rods are of differing lengths, with at least some of said coil-guiding rods being relatively shorter than other of said coil-guiding rods, at least some of said coil-guiding rods are straight and wherein other of said coil-guiding rods are bent to define respective axially-inwardly extending segments.

8. A coiler apparatus according to claim 1, wherein said rotating arm compises a hollow tube for receiving the strand in an upstream strand-receiving opening therein and discharging said strand through a downstream, radially-outwardly extending opening therein positioned in closely spaced-apart relation to said template for depositing the strand thereon.

9. A coiler apparatus for forming flat coils of textile strands from an upstream strand supply and depositing them on a moving conveyor belt for transport downstream to a strand processing station, comprising:

(a) a coil-former for forming the strand into an upright, circular coil on a downstream-facing annular, tapered coil-forming surface;

(b) a coil-doffer for removing a lower portion of said coil from said coil-forming surface and moving it onto said conveyor belt at a first rate of travel and for removing an upper portion of said coil from said coil-forming surface and moving it onto said conveyor belt at a second rate of travel which is different than said first rate of travel whereby the difference in rate of travel between the upper and lower portions of the coil alters the shape of the coil from circular on said coil-forming surface to oval on said conveyor.

10. A coiler apparatus according to claim 9,wherein said coil doffer comprises an endless doffing conveyor for removing the lower portion of the coil from the coil-forming surface.

11. A coiler apparatus according to claim 10, wherein said endless doffing conveyor comprises a pair of laterally spaced-apart endless doffing belts, each of said doffing belts defining a coil-doffing upper surface for moving the lower portion of said coils downstream therefrom.

12. A coiler apparatus according to claim 11, wherein said pair of laterally spaced-apart endless doffing belts engage and are driven by surface-to-surface contact with said conveyor belt.

13. A coiler apparatus according to claim 9, wherein said coil doffer comprises a plurality of coil-guiding rods positioned in coil-receiving relation to said coil-former and extending outwardly from said coil-former in a downstream and downwardly-extending direction towards said conveyor belt for removing the upper portion of said coils from said coil-former and depositing them on said conveyor belt.

14. A coiler apparatus according to claim 13, wherein said coil-guiding rods are of differing lengths, with at least some of said coil-guiding rods being relatively shorter than other of said coil-guiding rods, and further wherein at least some of said coil-guiding rods are straight and wherein other of said coil-guiding rods are bent to define respective axially-inwardly extending segments, said coil-guiding rods collectively cooperating to assist formation of the circular coil on said coil former into the oval coil on said conveyor belt.

15. A method for forming flat coils of textile strands from an upstream strand supply and depositing the coils on a moving conveyor belt for transport downstream to a strand processing station, comprising the steps of:

(a) forming successive circular coils of a textile strand received from the upstream strand supply;

(b) receiving and supporting each circular coil in an upright orientation on a coil support as it is formed;

(c) progressively doffing a lower portion of successive ones of said coils from said coil support;

(d) progressively doffing the upper portion of said coils from the coil support as the lower portion of the coils is doffed; and (e) controlling the relative downstream rate of travel of the upper and lower portions of said coils from their upright, circular orientation whereby said coils are deposited onto the conveyor belt in an overlapping array of oval-shaped coils.

16. A method according to claim 15, wherein the step of supporting said coils comprises the step of placing each of the coils successively on a downstream-facing annular surface of the coil support.

17. A method according to claim 15, wherein the step of doffing the upper portion of the coils comprises the step of guiding the upper portion of tie coils off of the coil support onto a plurality of guide members extending downstream and downwardly towards the conveyor belt.

18. A method according to claim 15, wherein the step of doffing the lower portion of said coils comprises the step of engaging the coils and moving them at a predetermined rate of travel onto the conveyor belt.

* * * * *